US009340911B2

(12) United States Patent
Hasegawa et al.

(10) Patent No.: US 9,340,911 B2
(45) Date of Patent: May 17, 2016

(54) SEWING MACHINE

(71) Applicants: Katsuhisa Hasegawa, Kasugai (JP); Shin Ota, Inazawa (JP); Kenichi Mizuno, Nagoya (JP)

(72) Inventors: Katsuhisa Hasegawa, Kasugai (JP); Shin Ota, Inazawa (JP); Kenichi Mizuno, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 589 days.

(21) Appl. No.: 13/790,618

(22) Filed: Mar. 8, 2013

(65) Prior Publication Data

US 2013/0255555 A1 Oct. 3, 2013

(30) Foreign Application Priority Data

Mar. 28, 2012 (JP) ..... 2012-072911

(51) Int. Cl.

| | |
|---|---|
| ***D05B 69/00*** | (2006.01) |
| ***D05B 69/30*** | (2006.01) |
| ***D05B 69/12*** | (2006.01) |
| ***D05B 55/00*** | (2006.01) |
| ***D05B 69/02*** | (2006.01) |

(52) U.S. Cl.

CPC ..... *D05B 69/30* (2013.01); *D05B 55/00* (2013.01); *D05B 69/02* (2013.01); *D05B 69/12* (2013.01)

(58) Field of Classification Search

CPC ..... D05B 3/02; D05B 55/00; D05B 69/02; D05B 69/30

USPC ..... 112/221

See application file for complete search history.

(56) References Cited

U.S. PATENT DOCUMENTS

| | | | | |
|---|---|---|---|---|
| 2,773,463 | A * | 12/1956 | Jullie | 112/132 |
| 3,713,407 | A * | 1/1973 | Ciecior | 112/221 |
| 4,428,311 | A * | 1/1984 | Sano | 112/466 |
| 4,458,611 | A * | 7/1984 | Arendash | 112/443 |
| 4,515,098 | A * | 5/1985 | Walther | 112/274 |
| 7,367,274 | B2 * | 5/2008 | Sadasue | 112/122 |

FOREIGN PATENT DOCUMENTS

| | | |
|---|---|---|
| JP | Y2-58-051900 | 11/1983 |
| JP | Y2-03-033323 | 7/1991 |
| JP | Y2-03-050867 | 10/1991 |
| JP | U-06-021588 | 3/1994 |

OTHER PUBLICATIONS

U.S. Appl. No. 13/790,699, filed Mar. 8, 2013 in the name of Hasegawa et al.

* cited by examiner

*Primary Examiner* — Nathan Durham
(74) *Attorney, Agent, or Firm* — Oliff PLC

(57) ABSTRACT

A sewing machine includes a needle bar base, a support shaft, an adjustment member, and an urging portion. The needle bar base has a through hole on an upper end portion. The support shaft is inserted through the through hole and pivotably supports the needle bar base. The support shaft includes a leading end portion. The leading end portion includes a first screw portion. The adjustment member is provided on the support shaft and is configured to move along an axial direction of the support shaft. The adjustment member includes a second screw portion and a first contact portion. The second screw portion is screwed into the first screw portion. The first contact portion is in contact with the needle bar base. The urging portion urges the needle bar base toward the first contact portion of the adjustment member.

2 Claims, 10 Drawing Sheets

SEWING MACHINE

CROSS-REFERENCE TO RELATED APPLICATION

This application claims priority to Japanese Patent Application No. 2012-072911, filed Mar. 28, 2012, the content of which is hereby incorporated herein by reference in its entirety.

BACKGROUND

The present disclosure relates to a sewing machine in which a magnitude of a gap between a sewing needle and a hook point of a shuttle can be adjusted.

In related art, a sewing machine is mainly provided with a bed portion, a pillar, an arm portion and a head portion. The arm portion includes a drive shaft that is driven by a sewing machine motor. The head portion includes a needle bar base that supports a needle bar. Due to the rotation of the drive shaft, the needle bar moves in the up-down direction. The bed portion includes a shuttle that rotates in accordance with a rotation of a lower shaft that moves in connection with the drive shaft. Due to the concerted movement of the needle bar and the shuttle, an upper thread that is supplied to a sewing needle attached to the needle bar is interlaced with a lower thread that is supplied from a bobbin housed in the shuttle, thus forming a stitch on a work cloth.

In a sewing machine, in order to reliably form stitches, adjustment of a magnitude of a gap between a sewing needle and a hook point of the shuttle is important. Thus, the sewing machine includes a mechanism that can adjust the gap between the sewing needle and the hook point of the shuttle. Hereinafter, the gap between the sewing needle and the hook point of the shuttle is referred to as a needle gap. For example, a sewing machine is known that is provided with a needle bar base that supports a needle bar, a holding shaft and two clips. The holding shaft is inserted into a hole in the upper portion of the needle bar base, and rotatably supports the needle bar base. The two clips are attached to the holding shaft such that the two clips clamp the upper portion of the needle bar base. The two clips regulate the movement of the needle bar base in the axial direction of the holding shaft. The holding shaft is inserted into a hole that is formed in a sewing machine arm, and is fixed inside the hole by a screw. In the sewing machine, the adjustment of the needle gap is performed by loosening the screw and causing the holding shaft to move slightly in the axial direction.

SUMMARY

However, in order for an operator to adjust the needle gap, the operator slightly moves the holding shaft with his or her fingers by feel, while visually checking the gap between the sewing needle and the hook point. There are therefore cases in which technical skill and experience is needed to perform the adjustment of the needle gap.

Embodiments of the broad principles derived herein provide a sewing machine in which fine adjustment of a needle gap can be easily performed by an operator without use of a tool.

Embodiments provide a sewing machine that includes a needle bar base, a support shaft, an adjustment member, and an urging portion. The needle bar base supports a needle bar such that the needle bar can move in the up-down direction, and has a through hole on an upper end portion. The support shaft is inserted through the through hole and pivotably supports the needle bar base. The support shaft includes a leading end portion. The leading end portion includes a first screw portion. The adjustment member is provided on the support shaft and is configured to move along an axial direction of the support shaft. The adjustment member includes a second screw portion and a first contact portion. The second screw portion is screwed into the first screw portion. The first contact portion is in contact with the needle bar base. The urging portion urges the needle bar base toward the first contact portion of the adjustment member.

BRIEF DESCRIPTION OF THE DRAWINGS

Embodiments will be described below in detail with reference to the accompanying drawings in which.

DETAILED DESCRIPTION

Figure 1:
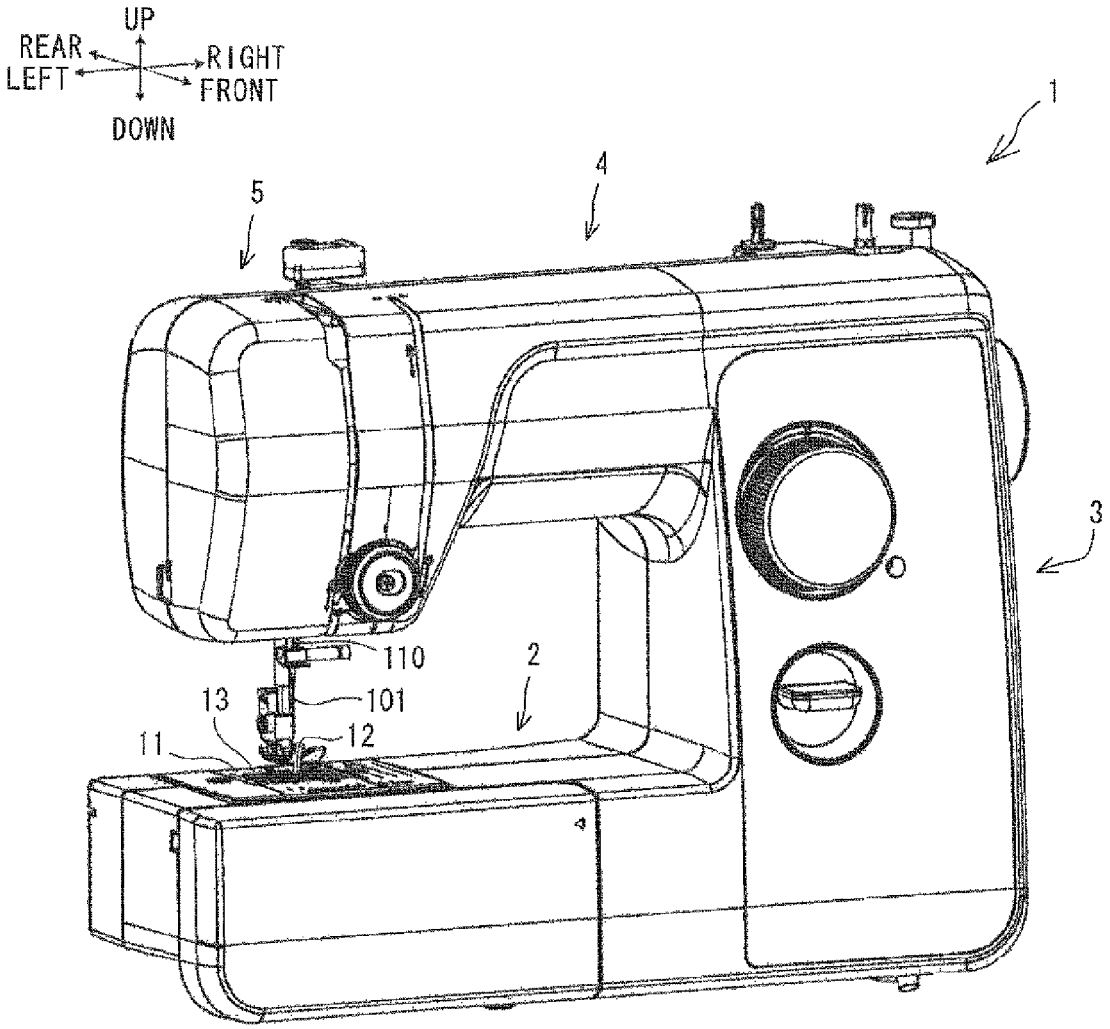
FIG. 1 is a perspective view of a sewing machine.

Hereinafter, a sewing machine 1 according to an embodiment of the present disclosure will be explained with reference to the drawings. The referenced drawings are used to illustrate technological features that can be adopted by the present disclosure. Configurations and so on of devices illustrated in the drawings are not intended to limit the present disclosure and are simply explanatory examples.

A configuration of the sewing machine 1 will be explained with reference to FIG. 1 and FIG. 2. Note that, in the following explanation, the lower right side, the upper left side, the lower left side, and the upper right side of FIG. 1 are, respectively, the front side, the rear side, the left side and the right side of the sewing machine 1. The front-rear direction and the left-right direction shown in FIG. 3 and subsequent drawings correspond to the front-rear direction and the left-right direction of the sewing machine 1.

As shown in FIG. 1, the sewing machine 1 includes a bed portion 2, a pillar 3, an arm portion 4, and a head portion 5. The bed portion 2 extends in the left-right direction and is provided with a horizontal shuttle 8 (refer to FIG. 2) that is disposed internally and to the left in the bed portion 2. The pillar 3 extends in the upper direction from a right end portion of the bed portion 2. The pillar 3 is provided internally with a sewing machine motor (not shown in the drawings) and the like. The arm portion 4 extends in the leftward direction from an upper portion of the pillar 3, such that the arm portion 4 is opposite the surface of the bed portion 2. The anti portion 4 is provided internally with a drive shaft 51 (refer to FIG. 2) and the like. The head portion 5 is provided on the left side of the arm portion 4. The head portion 5 is provided internally with a needle bar module 10 (refer to FIG. 2) and the like. The needle bar module 10 includes a needle bar support mechanism 100 that will be described later. The needle bar support mechanism 100 includes a needle bar 110 that can move in the up-down direction. The needle bar 110 extends downward from the lower side of the head portion 5. A sewing needle 101 may be attached to the lower end of the needle bar 110.

Figure 2:
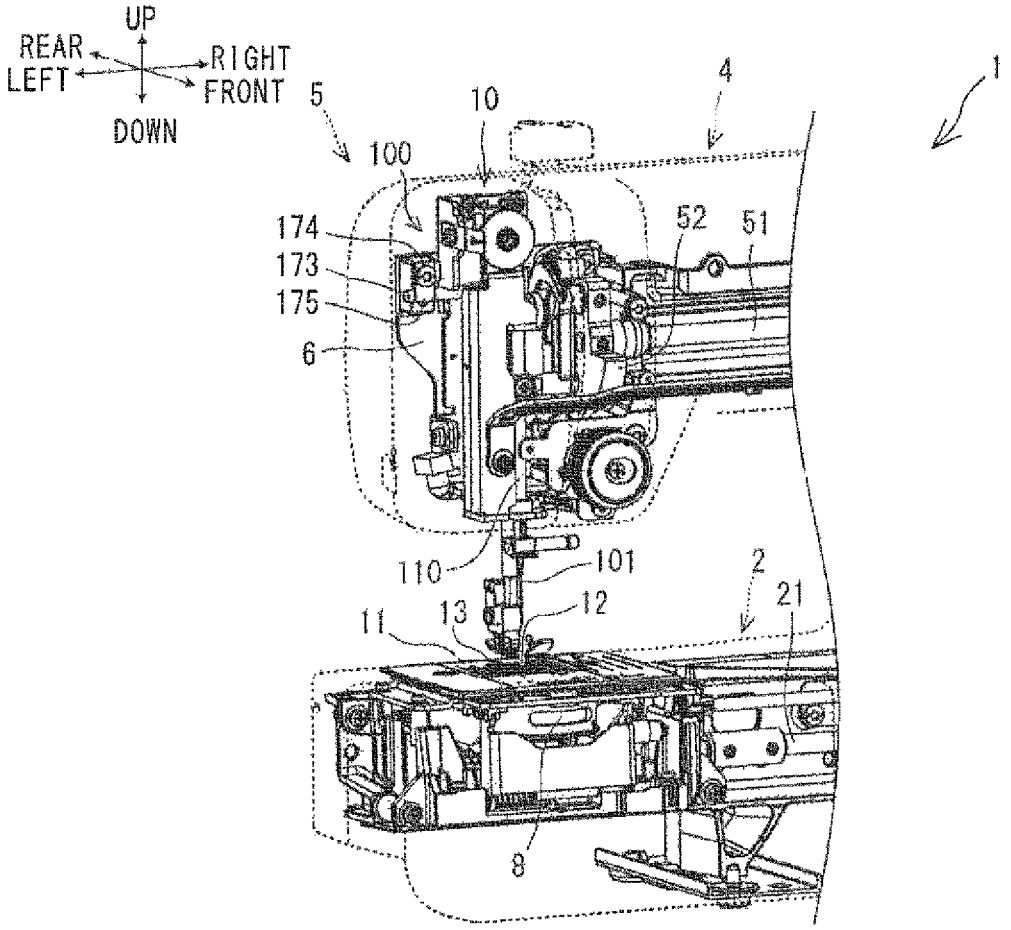
FIG. 2 is a perspective view showing an internal configuration of left side sections of a head portion and a bed portion of the sewing machine.

As shown in FIG. 2, a needle plate 11 is provided on the upper portion of the bed portion 2. The needle plate 11 has a needle hole 12 that is positioned directly below the sewing needle 101 attached to the needle bar 110, such that the sewing needle 101 can pass through the needle hole 12. The horizontal shuttle 8, which houses a bobbin (not shown in the drawings) on which a lower thread (not shown in the drawings) may be wound, is provided below the needle plate 11. The horizontal shuttle 8 may rotate in the horizontal direction in accordance with the rotation of the lower shaft 21 that rotates in concert with the drive shaft 51. The horizontal shuttle 8 includes a hook point 9 (refer to FIG. 9) whose leading end portion is directed in a peripheral direction. The hook point 9 may pick up a loop (hereinafter referred to as an upper thread loop) 106 of an upper thread 107 (refer to FIG. 9). Further, when the needle bar 110 is caused to descend by driving of a needle bar drive mechanism 16, the sewing needle 101 attached to the needle bar 110 moves to a position close to the hook point 9 of the horizontal shuttle 8 (refer to FIG. 9). An explanation of the upper thread loop 106 and the needle bar drive mechanism 16 will be described later. A feed dog 13, which is configured to move a work cloth by a predetermined feed amount, is provided below the needle plate 11.

Figure 3:
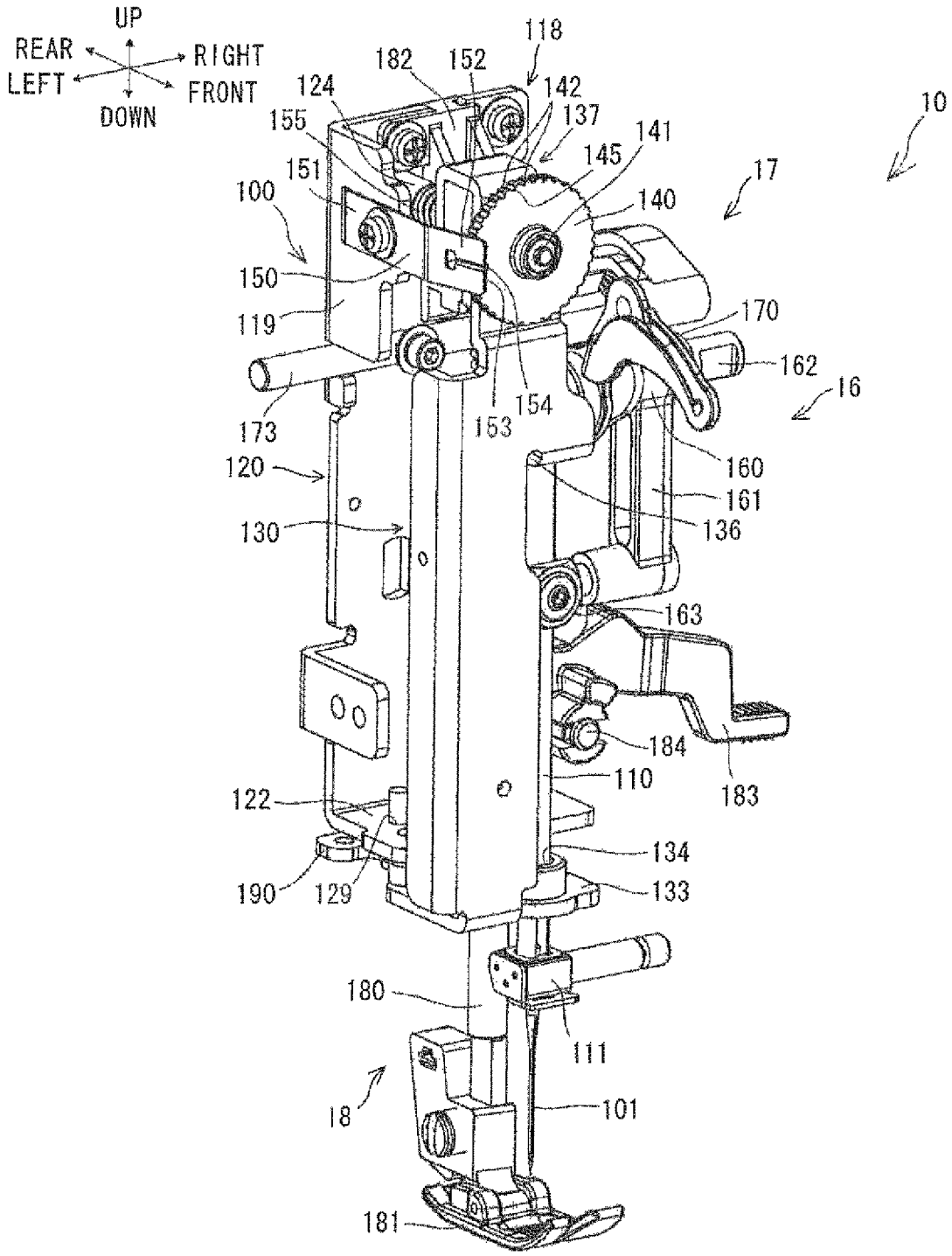
FIG. 3 is a perspective view of a needle bar module.

Next, a configuration of the needle bar module 10 that is provided on the head portion 5 will be explained with reference to FIG. 2 to FIG. 8. The needle bar module 10 shown in FIG. 2 and FIG. 3 is a module that is formed by integrating the needle bar support mechanism 100, the needle bar drive mechanism 16, a thread take-up drive mechanism 17 and a presser raising/lowering mechanism 18. The needle bar support mechanism 100 is configured to support the needle bar 110 to which the sewing needle 101 is attached. The needle bar drive mechanism 16 may cause the needle bar 110 to reciprocate in the up-down direction. The thread take-up drive mechanism 17 may drive a thread take-up lever 170 (refer to FIG. 3). The presser raising/lowering mechanism 18 may raise and lower a presser bar 180 (refer to FIG. 3). The needle bar module 10 is fixed to a machine frame 6 provided inside the head portion 5. The rotation of the drive shaft 51 may be transmitted to the needle bar drive mechanism 16 and the thread take-up drive mechanism 17 and the needle bar drive mechanism 16 and the thread take-up drive mechanism 17 may thus be driven.

As shown in FIG. 3, FIG. 4, FIG. 5 and FIG. 7, the needle bar support mechanism 100 includes a base holder 120. The base holder 120 is a metal plate that extends in the up-down direction. A support shaft 173, which extends in the left-right direction, is fixed to the base holder 120, slightly above the center of the base holder 120 in the up-down direction. The length of the support shaft 173 is longer than the length, in the left-right direction, of the base holder 120. The support shaft 173 protrudes from the base holder 120 in the left and right directions. The left end portion of the support shaft 173 is fixed to the machine frame 6 by a presser plate 175 and a screw 174 (refer to FIG. 2). Although not shown in the drawings, the right end portion of the support shaft 173 is also fixed to the machine frame 6 in the same manner. Although not shown in the drawings, the lower end portion of the base holder 120 is fixed to the machine frame 6 such that an inclination (as seen from the side view) of the base holder 120 can be adjusted. In a case where the screw 174 that fixes the support shaft 173 is slightly loosened, the base holder 120 can be pivoted around the support shaft 173, in the side view. Thus, the base holder 120 can be fixed to the machine frame 6 after the position of the base holder 120 in relation to the machine frame 6 is adjusted.

The base holder 120 includes a support portion 122. The support portion 122 is a portion that is formed by bending the lower portion of the base holder 120 such that the support portion 122 extends toward the front. A support hole 185, which penetrates the support portion 122 in the up-down direction, is formed in a position toward the right side of the support portion 122. A protruding portion 123 (refer to FIG. 5), which protrudes downward from the support portion 122, is provided in a position toward the left side and toward the front of the support portion 122. A screw hole 129, which penetrates the support portion 122 in the up-down direction, is formed toward the left side and toward the rear of the support portion 122.

Figure 4:
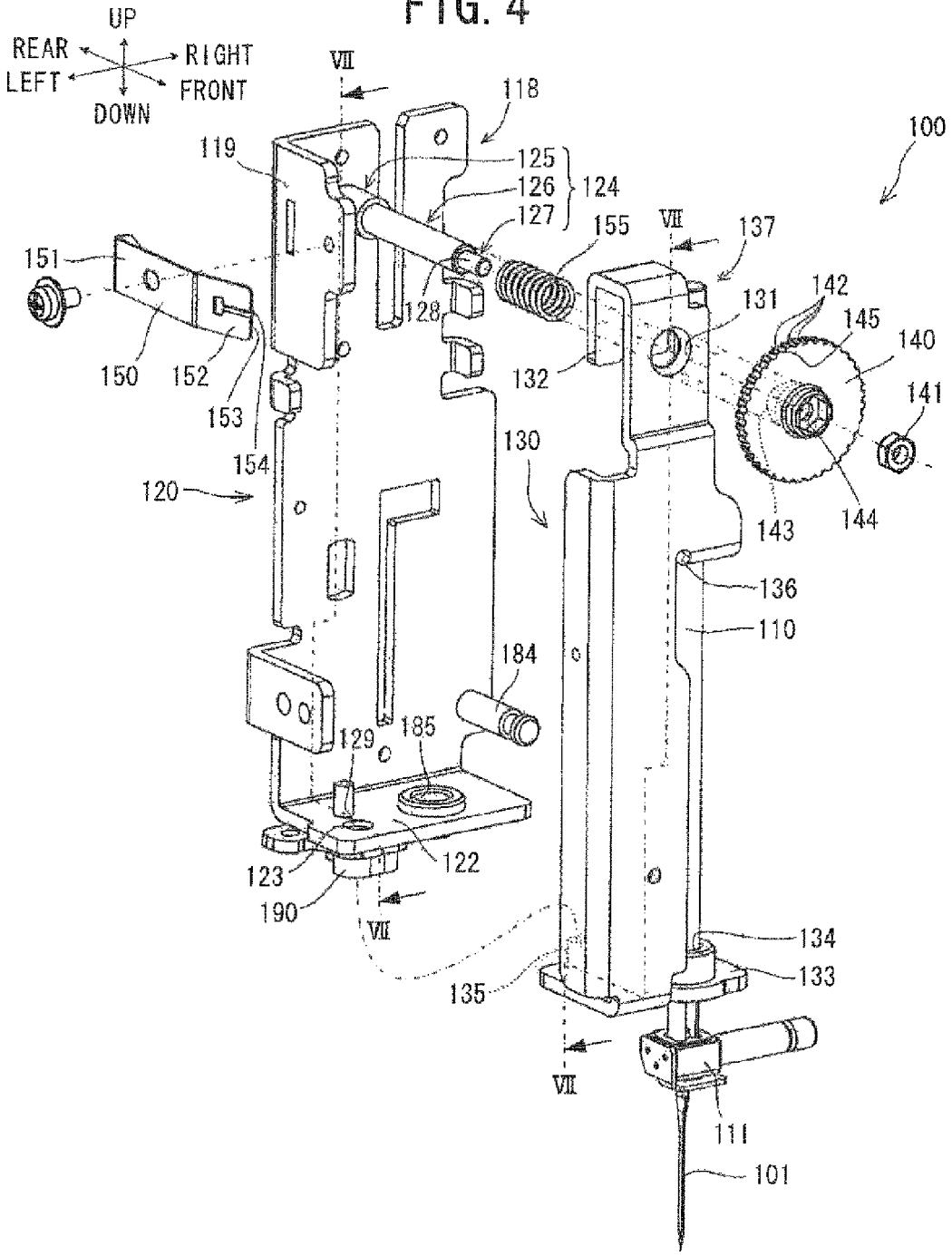
FIG. 4 is an exploded perspective view of a needle bar support mechanism.

The presser bar 180, which extends in the up-down direction, is inserted through the support hole 185 (refer to FIG. 4). A presser foot 181 is attached to the lower end portion of the presser bar 180. The upper end portion of the presser bar 180 is supported by a support piece 182 that is attached to the upper portion of the base holder 120. In this manner, the presser bar 180 may be supported on the base holder 120 such that the presser bar 180 can move in the up-down direction. A presser spring (not shown in the drawings) is provided around the presser bar 180. The presser bar 180 is urged in the downward direction by the urging force of the presser spring. A lever shaft 184, which protrudes toward the front, is provided on the lower portion of the base holder 120 to the right. A presser lever 183 is supported such that the presser lever 183 can pivot in relation to the lever shaft 184. The presser bar 180 and the presser foot 181 can be raised and lowered by an operator operating the presser lever 183. As described above, the presser bar 180, the presser foot 181, the presser spring and the presser lever 183 may form the presser raising/lowering mechanism 18.

The thread take-up lever 170 and the thread take-up drive mechanism 17 are disposed to the right of the base holder 120. The thread take-up lever 170 and the thread take-up drive mechanism 17 are known mechanisms and are thus briefly explained here. A thread take-up crank 52 is fixed to the left end portion of the drive shaft 51. The thread take-up crank 52 may rotate integrally with the drive shaft 51. The thread take-up drive mechanism 17 may be driven by the rotation of the thread take-up crank 52. By the driving of the thread take-up drive mechanism 17, the thread take-up lever 170 moves in the up-down direction in time with the reciprocating motion in the up-down direction of the needle bar 110.

Figure 5:
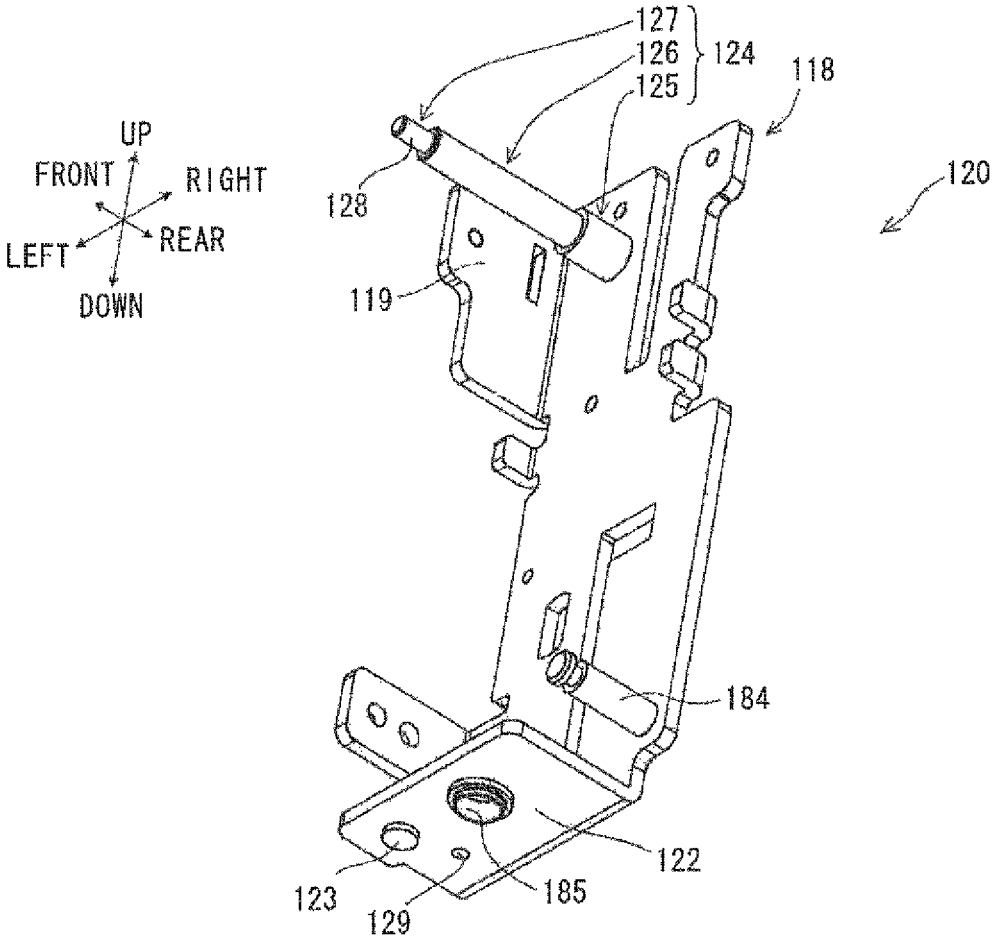
FIG. 5 is a perspective view of a base holder.
Figure 6:
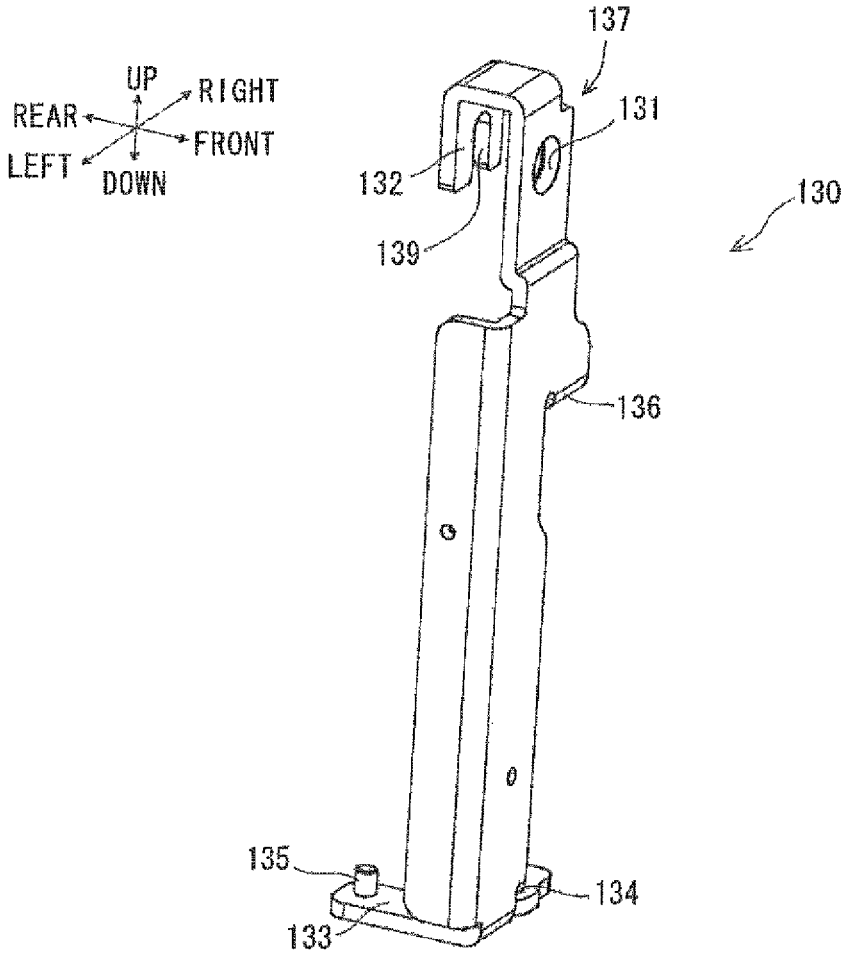
FIG. 6 is a perspective view of a needle bar base.
Figure 7:
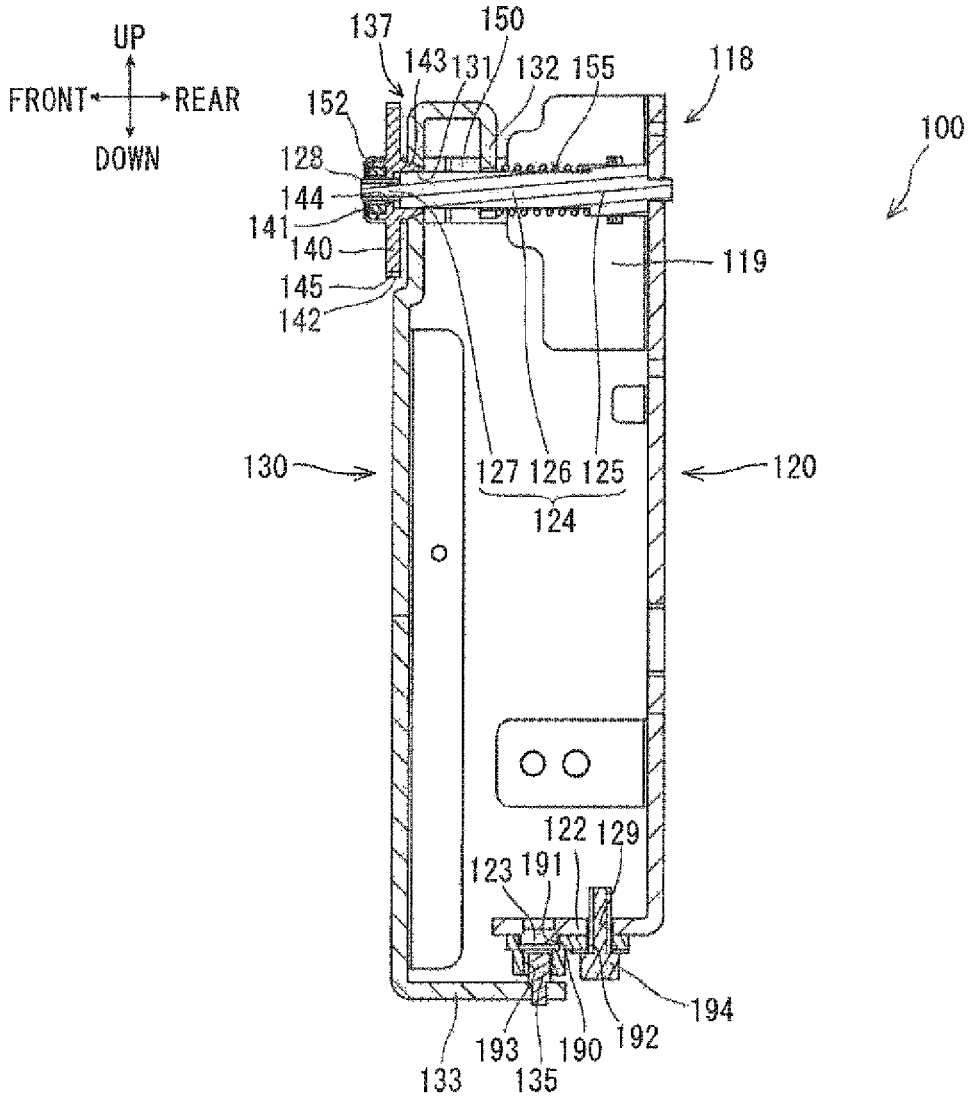
FIG. 7 is a cross-sectional view of the needle bar support mechanism, as seen in the direction of arrows along dotted lines VII-VII shown in FIG. 4.

As shown in FIG. 4, FIG. 5 and FIG. 7, the base holder 120 includes an upper end portion 118. The upper end portion 118 includes a support shaft 124 that extends toward the front. The support shaft 124 includes a base end portion 125, a trunk portion 126 and a leading end portion 127. The trunk portion 126 is formed having a smaller diameter than that of the base end portion 125, and extends in the front-rear direction. The leading end portion 127 is formed having a smaller diameter than that of the trunk portion 126, and a male screw 128 is formed on the leading end portion 127. The male screw 128 is a right-hand thread screw. The base holder 120 includes an attachment portion 119. The attachment portion 119 is a portion that is formed by bending the left upper portion of the base holder 120 such that the attachment portion 119 extends toward the front. A plate spring 150 that will be described later is fixed to the attachment portion 119.

The needle bar support mechanism 100 includes a needle bar base 130. The needle bar base 130, shown in FIG. 4, FIG.

6 and FIG. 7, is formed of a metal plate that extends in the up-down direction. A through hole 131 is formed on an upper end portion 137 of the needle bar base 130 such that the through hole 131 penetrates the upper end portion 137 in the front-rear direction. The inner diameter of the through hole 131 is slightly larger than the outer diameter of the trunk portion 126 of the support shaft 124. The edge line of the mouth of the through hole 131 on the front side has a tapered shape by chamfering. The needle bar base 130 includes a pressing portion 132. The pressing portion 132 is a portion that is formed by bending back the leading end portion of the upper portion of the needle bar base 130 in the downward direction. A groove 139, an opening of which faces downward, is formed in the pressing portion 132. The width of the groove 139 in the left-right direction is slightly larger than the outer diameter of the trunk portion 126, and thus the trunk portion 126 may fit into the groove 139.

The needle bar base 130 includes a support portion 133. The support portion 133 is a portion that is formed by bending the lower portion of the needle bar base 130 toward the rear. A hole 134, which penetrates the support portion 133 in the up-down direction, is formed in a position toward the right side of the support portion 133. A portion toward the left side of the support portion 133 protrudes further to the rear. The support portion 133 includes a pin 135 that protrudes upward from the rear portion of the support portion 133. A direction of extension of the pin 135 is parallel to the needle bar 110. Further, the needle bar base 130 includes a bent portion 136 that is provided on the upper side of the center of the needle bar base 130 in the up-down direction. The bent portion 136 is a portion that is formed by bending, toward the rear, the upper portion of the needle bar base 130 above the center in the up-down direction, such that the bent portion 136 is parallel to the support portion 133. A hole (not shown in the drawings) having a same inner diameter as that of the hole 134 is also formed in the bent portion 136. As shown in FIG. 4, the needle bar 110 is inserted into and supported by the hole 134 and the hole of the bent portion 136, such that the needle bar 110 can move in the up-down direction. That is, the needle bar base 130 is configured to support the needle bar 110 such that the needle bar 110 can move in the up-down direction. An attachment portion 111, to which the sewing needle 101 can be removably attached, is provided on the lower end portion of the needle bar 110.

As shown in FIG. 4 and FIG. 7, a compression coil spring 155 is mounted around the outer periphery of the trunk portion 126. The rear end side of the compression coil spring 155 is in contact with a stepped portion between the trunk portion 126 and the base end portion 125. The support shaft 124 is inserted through the through hole 131 of the needle bar base 130 and through the groove 139. In this manner, the needle bar base 130 is supported by the support shaft 124 in a state in which the needle bar base 130 can rotate around the support shaft 124. The leading end side of the compression coil spring 155 is in contact with the pressing portion 132 of the needle bar base 130. In other words, the compression coil spring 155 is disposed between the base holder 120 and the needle bar base 130.

Figure 8:
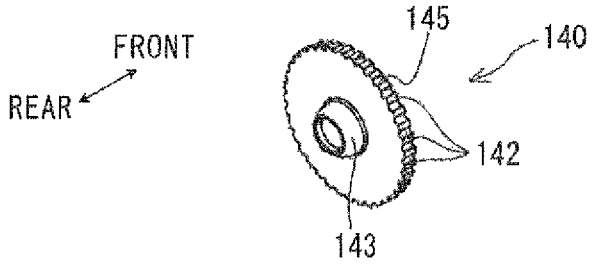
FIG. 8 is a perspective view of an adjustment dial.

A disc-shaped adjustment dial 140 is provided on the leading end portion 127 of the support shaft 124. As shown in FIG. 4, FIG. 7 and FIG. 8, a hole 144 is formed in the center of the disc surface of the adjustment dial 140. The trunk portion 126 of the support shaft 124 can be inserted through the hole 144. On the front disc surface of the adjustment dial 140, a nut 141 that is positioned concentrically with the hole 144 is fittingly inserted into the hole 144 and fixed. A hemispheric contact portion 143, which is open in a position corresponding to the hole 144, is formed on the rear disc surface of the adjustment dial 140. Further, a plurality of protrusions 142 are formed around an outer peripheral surface 145 of the adjustment dial 140. The plurality of protrusions 142 protrude in the radial direction of the adjustment dial 140. For example, sharp-angled portions of the protrusions 142 extend in the thickness direction (the front-rear direction) of the disc at equal intervals in the peripheral direction, and form a so-called straight knurl shape. Note that in the present embodiment, the outer peripheral surface 145 of the adjustment dial 140 includes the surface of the protrusions 142.

As shown in FIG. 4 and FIG. 7, the support shaft 124 may be inserted through the through hole 131 of the needle bar base 130, and the leading end portion 127 may be inserted through the hole 144 in the adjustment dial 140 from the side of the contact portion 143. The male screw 128 formed on the leading end portion 127 screws into a female screw of the nut 141. The contact portion 143 of the adjustment dial 140 is in contact with the tapered surface at the mouth of the through hole 131 of the needle bar base 130. When the contact portion 143 is in contact with the tapered surface of the through hole 131, the compression coil spring 155 is pressed in the rearward direction by the pressing portion 132 of the needle bar base 130, and is compressed in the axial direction of the support shaft 124. Specifically, the compression coil spring 155 urges the pressing portion 132 of the needle bar base 130 toward the side of the leading end portion 127, from the side of the base end portion 125 of the support shaft 124. In other words, between the base holder 120 and the adjustment dial 140, the needle bar base 130 is in a state of being urged toward the side of the adjustment dial 140, due to the urging force of the compression coil spring 155. As described above, the male screw 128 is a right-hand thread screw. Thus, when the adjustment dial 140 is rotated in the clockwise direction, the adjustment dial 140 and the needle bar base 130 move toward the rear. In contrast, when the adjustment dial 140 is rotated in the counterclockwise direction, the adjustment dial 140 and the needle bar base 130 move toward the front. In this manner, by rotating the adjustment dial 140, the adjustment dial 140 moves in the axial direction of the support shaft 124. Accordingly, the needle bar base 130 moves in the axial direction of the support shaft 124.

A guide member 190 is provided on the lower surface of the support portion 122 of the base holder 120. As shown in FIG. 7, a hole portion 191 and an insertion hole 192 are formed in the guide member 190. The hole portion 191 may engage with the protruding portion 123 of the support portion 122. A screw 194 that may screw into a screw hole 129 is inserted through the insertion hole 192. The guide member 190 may be fixed to the lower surface of the support portion 122 by tightening the screw 194. The guide member 190 includes a groove portion 193, which extends in the left-right direction and which has an open portion that faces downward. A pin 135, which is provided on the support portion 133 of the needle bar base 130, may engage with the groove portion 193. The pin 135 can move in the left-right direction along the groove portion 193, but is unable to move in the front-rear direction. As the upper end portion 137 of the needle bar base 130 is supported by the support shaft 124, as described above, the needle bar base 130 can pivot in the left-right direction around the support shaft 124. The needle bar base 130 may pivot in the left-right direction by the pin 135 that is engaged with the groove portion 193 moving in the left-right direction.

As shown in FIG. 3, FIG. 4 and FIG. 7, the rectangular plate spring 150 is attached to the attachment portion 119, which is provided on the left side of the upper end portion 118 of the base holder 120. The plate spring 150 includes a first end portion 151 and a second end portion 152. The first end portion 151 is screwed to the attachment portion 119, thus fixing the plate spring 150 to the attachment portion 119. The second end portion 152 is formed by bending the plate spring 150 slightly toward the right. The second end portion 152 extends from the first end portion 151 toward the right and the front, and is positioned to the left of the adjustment dial 140. The adjustment dial 140 is positioned to the right of the second end portion 152, and the second end portion 152 that bends slightly to the right is in contact with the outer peripheral surface 145 of the adjustment dial 140. As the second end portion 152 is in contact with the outer peripheral surface 145, the second end portion 152 urges the adjustment dial 140 to move inward in the radial direction, from a section of contact with the outer peripheral surface 145. Hereinafter, the portion of the second end portion 152 that is in contact with the outer peripheral surface 145 of the adjustment dial 140 is referred to as a contact portion 153. More specifically, the contact portion 153 is in contact with protruding leading ends of the protrusions 142 that form a part of the outer peripheral surface 145 of the adjustment dial 140.

The contact portion 153 includes a protrusion 154. The protrusion 154 is a rib-shaped portion that is provided on the right surface of the second end portion 152 and that extends in the front-rear direction. The width of the protrusion 154 is smaller than a size of a gap between two of the protruding portions 142 that are adjacent, of the plurality of protruding portions 142 that are formed on the outer peripheral surface 145 of the adjustment dial 140. Thus, in a state in which the contact portion 153 is in contact with the outer peripheral surface 145 of the adjustment dial 140, the protrusion 154 is mainly positioned between the two adjacent protruding portions 142. As a result, the rotation of the adjustment dial 140 is regulated by the urging force of the plate spring 150. However, the adjustment dial 140 can be caused to rotate by resisting the urging force of the second end portion 152, thus pushing the protrusion 154 of the contact portion 153 outward in the radial direction of the adjustment dial 140 such that the protrusion 154 passes over the protruding portions 142. In other words, by rotating the adjustment dial 140 in resistance to the urging force of the second end portion 152, the operator can adjust the position of the needle bar base 130. However, when the operator does not rotate the adjustment dial 140, the rotation of the adjustment dial 140 is regulated by the urging force of the plate spring 150.

As shown in FIG. 3, a needle bar connecting stud 163, which may hold the needle bar 110, is provided on the needle bar drive mechanism 16, in a position between the support portion 133 and the bent portion 136. The needle bar connecting stud 163 may hold the middle portion of the needle bar 110. The needle bar connecting stud 163 is coupled to the leading end of a crank rod 161 that is connected to a needle bar crank 160. The needle bar crank 160 is coupled, via a connecting pin 162, to the thread take-up crank 52 (refer to FIG. 2). When the thread take-up crank 52 rotates in accordance with the rotation of the drive shaft 51 (refer to FIG. 2), the needle bar crank 160 rotates and drives the crank rod 161. The needle bar crank 160, the crank rod 161 and the needle bar connecting stud 163 work in concert with each other, and convert the rotational movement of the drive shaft 51 into a reciprocating motion in the up-down direction, thus moving the needle bar 110 up and down.

Figure 9:
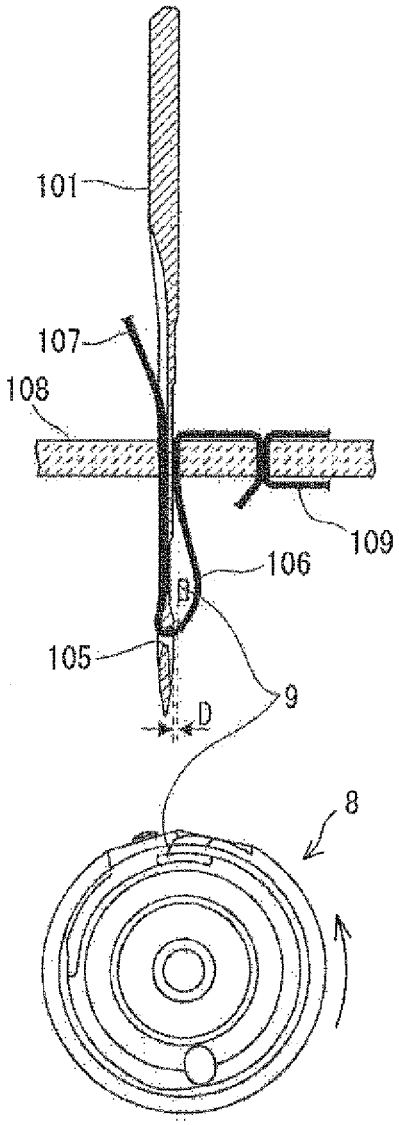
FIG. 9 is an explanatory diagram illustrating forming of stitches.

Formation of the stitches will be explained with reference to FIG. 9. For ease of explanation, the horizontal shuttle 8 and the hook point 9 are shown schematically, and the upper thread 107 and a lower thread 109 are partially shown. The sewing needle 101 attached to the needle bar 110 (refer to FIG. 2) and the horizontal shuttle 8 work in concert with each other, thus the stitches may be formed on a work cloth 108. In order to form the stitches, the upper thread loop 106 that is formed in an eye 105 of the sewing needle 101 has to be reliably picked up by the hook point 9 of the horizontal shuttle 8. In a case where the upper thread loop 106 is not picked up by the hook point 9, a skipped stitch occurs in which the stitch is not formed. As a result, the sewing quality may deteriorate. In order to inhibit this from occurring, it is necessary to properly adjust a needle gap D that is the gap between the sewing needle 101 and the hook point 9. In the sewing machine 1 of the present embodiment, the needle gap D is adjusted by adjusting (rotating) the adjustment dial 140.

When the operator rotates the adjustment dial 140, the needle bar base 130 moves in the front-rear direction. However, as described above, the pin 135 engages with the groove portion 193 of the guide member 190 that is fixed to the base holder 120, such that the pin 135 can move in the left-right direction but cannot move in the front-rear direction. In this manner, as the position of the pin 135 in the front-rear direction does not change even when the needle bar base 130 moves in the front-rear direction, the inclination of the needle bar base 130 changes slightly, generally centering on the position at which the pin 135 is engaged with the groove portion 193. To explain in more detail, in FIG. 7, when the adjustment dial 140 is moved toward the front, the upper portion of the needle bar base 130 inclines slightly toward the front, generally centering on the position at which the pin 135 is engaged with the groove portion 193. In contrast, when the adjustment dial 140 is moved toward the rear, the upper portion of the needle bar base 130 inclines slightly toward the rear, generally centering on the position at which the pin 135 is engaged with the groove portion 193. By changing the inclination of the needle bar base 130 in this manner, the sewing needle 101 that is attached to the lower end portion of the needle bar 110 (which is supported by the needle bar base 130) moves in a direction to approach the hook point 9 in accordance with the movement of the adjustment dial 140 toward the front. That is, in this case, the sewing needle 101 moves toward the rear. In contrast, the sewing needle 101 moves in a direction to separate from the hook point 9 in accordance with the movement of the adjustment dial 140 toward the rear. That is, in this case, the sewing needle 101 moves toward the front.

In the actual adjustment operation, in a state in which the needle plate 11 is removed, the operator looks at the horizontal shuttle 8 from the side of the sewing machine 1, and thus the operator can visually check the gap between the sewing needle 101 and the hook point 9 of the horizontal shuttle 8. Then, the operator may grasp the adjustment dial 140, which is easily operable from the front, with the operator's fingers and rotates the adjustment dial 140. As described above, when the adjustment dial 140 is rotated in the clockwise direction, the adjustment dial 140 and the needle bar base 130 move to the rear, and thus, the sewing needle 101 moves to the front and separates from the hook point 9. In contrast, when the adjustment dial 140 is rotated in the counterclockwise direction, the adjustment dial 140 and the needle bar base 130 move to the front, and thus, the sewing needle 101 moves to the rear and approaches the hook point 9. By the operator rotating the adjustment dial 140 in this manner, the gap between the sewing needle 101 and the hook point 9 can easily be adjusted.

As the operator can grasp and rotate the adjustment dial 140, fine adjustment in the rotation of the adjustment dial 140 can easily be performed by sensing with the operator's fingertips. Further, the protrusion 154 of the plate spring 150 is positioned between adjacent two of the protruding portions 142 of the adjustment dial 140. When the operator rotates the adjustment dial 140, the protrusion 154 passes over the protruding portions 142 and is positioned between other adjacent two of the protruding portion 142. When the protrusion 154 is positioned between the other adjacent two protruding portions 142, the operator can recognize a click feeling due to the urging force of the plate spring 150, and can thus more easily perform the fine adjustment in the rotation of the adjustment dial 140, by sensing with the operator's fingertips.

As described above, in the sewing machine 1 according to the present embodiment, by rotating the adjustment dial 140, the operator can easily adjust the position of the needle bar base 130, which is pressed toward the adjustment dial 140 by the compression coil spring 155, with respect to the support shaft 124. In other words, adjustment of the gap (the needle gap) between the sewing needle 101 that is attached to the needle bar 110 which is supported by the needle bar base 130 and the hook point 9 of the horizontal shuttle 8 is easily performed by simply rotating the adjustment dial 140. In addition, the operation of the adjustment dial 140 can be performed by the operator, using the operator's fingers, and can thus be easily performed without the use of tools.

Furthermore, by using the compression coil spring 155 as an urging member that is mounted around the outer periphery of the support shaft 124, the sewing machine 1 has a simple configuration, can be manufactured at a low cost, and can be easily assembled. In addition, as the plate spring 150 urges the adjustment dial 140 such that the adjustment dial 140 does not rotate, the movement of the adjustment dial 140 is regulated. Therefore, for example, it is possible to reliably inhibit the adjustment dial 140 from rotating unintentionally as a result of vibration occurring due to the running (operating) of the sewing machine and changing the position of the adjustment dial 140 with respect to the support shaft 124.

Further, as the adjustment dial 140 is formed in a disc shape, the operator can easily grasp the adjustment dial 140 with the operator's fingers and rotate the adjustment dial 140. The protruding portions 142 are formed in a plurality, along the peripheral direction of the adjustment dial 140, such that the protruding portions 142 protrude outward in the radial direction from the outer peripheral surface 145. The contact portion 153 of the plate spring 150 is urged such that the contact portion 153 is in contact with some of the protruding portions 142, and thus the unintentional rotation of the adjustment dial 140 is reliably inhibited using a simple and low cost configuration.

Figure 10:
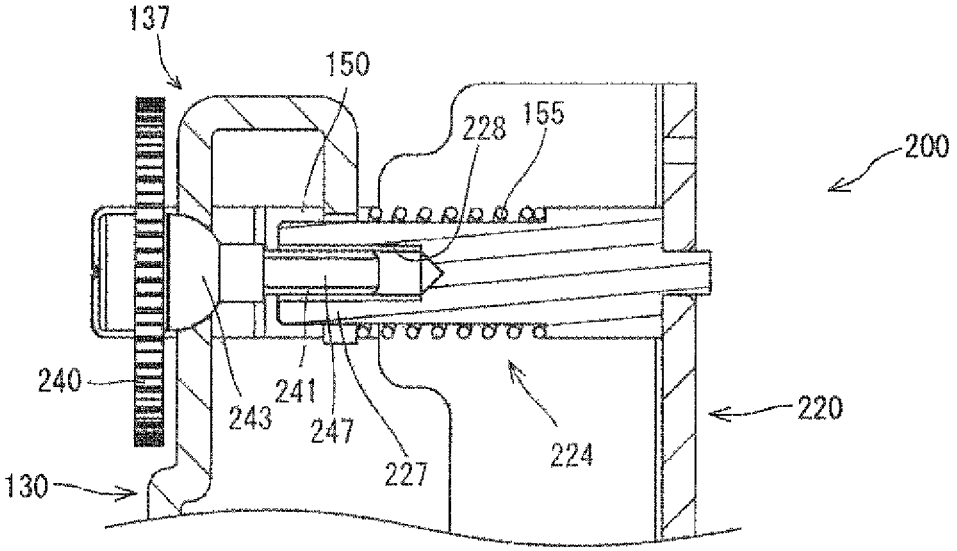
FIG. 10 is a partial cross-sectional diagram showing a modified example of an adjustment dial and a support shaft.

Note that various modifications can be made to the present disclosure in addition to the above-described embodiment. For example, a base holder 220 shown in FIG. 10 may be provided with a support shaft 224. A female screw 228 may be formed on a leading end portion 227 of the support shaft 224. In this case, on an adjustment dial 240, an adjustment shaft 247 forming a male screw 241 is provided such that the adjustment shaft 247 protrudes from a contact portion 243, and the male screw 241 and the female screw 228 may be screwed together. By rotating the adjustment dial 240, an operator may move the upper end portion 137 of the needle bar base 130 in the axial direction (the front-rear direction) of the support shaft 224 and thereby adjust the needle gap.

Furthermore, in the present embodiment, the configuration is adopted in which the needle bar module 10, which includes the needle bar support mechanism 100, the needle bar drive mechanism 16 and the other mechanisms, is fixed to the machine frame 6. However, the present disclosure is not limited to this configuration, and a configuration may be adopted in which individual components that form various mechanisms are attached directly to the machine frame 6.

In addition, the plate spring 150 is used as a regulating member to regulate the rotation of the adjustment dial 140, but another member may be used. The rotation of the adjustment dial 140 may be regulated by increasing the torque needed to rotate the nut 141. For example, as the compression coil spring 155, a compression coil spring having a large urging force may be used. Further, a locking nut may be used in place of the plate spring 150. Alternatively, slitting processing may be performed on the male screw 128 formed on the leading end 127 of the support shaft 124, such that a slit is formed in the axial direction of the male screw 128. As a further alternative, a sealing agent may be filled between the male screw 128 and the nut 141. Furthermore, small radial indentations and projections, which center around the shaft, may be provided on the contact portion 143 of the adjustment dial 140, and similarly, small radial indentations and projections may be provided on the tapered surface at the mouth of the through hole 131 of the needle bar base 130, such that the respective indentations and projections engage with each other.

In addition, a plate spring or a tension spring may be used in place of the compress coil spring 155. Further, the nut 141 may be omitted by directly forming a female screw on the adjustment dial 140.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar base that supports a needle bar such that the needle bar can move in an up-down direction, and which has a through hole on an upper end portion;

a support shaft that is inserted through the through hole and that pivotably supports the needle bar base, the support shaft including a leading end portion, and the leading end portion including a first screw portion;

a disk-shaped adjustment member that is provided on the support shaft and that is configured to move along an axial direction of the support shaft, the adjustment member including a second screw portion and a first contact portion, the second screw portion being disposed in the center of the adjustment member, the second screw portion being screwed into the first screw portion, the first contact portion being in contact with the needle bar base, the adjustment member including, on an outer peripheral surface, a plurality of protruding portions along a peripheral direction, and the plurality of protruding portions protruding outward in a radial direction of the adjustment member;

a plate spring regulating portion that regulates rotation of the second screw portion of the adjustment member, the regulating member including a second contact portion that is urged inward in the radial direction of the adjustment member and that is in contact with the outer peripheral surface; and an urging portion that urges the needle bar base toward the first contact portion of the adjustment member.

2. The sewing machine according to claim 1, wherein the urging portion is a compression coil spring that is mounted around an outer periphery of the support shaft.

* * * * *